US005931723A

United States Patent [19]

Katsuoka et al.

[11] Patent Number: 5,931,723

[45] Date of Patent: Aug. 3, 1999

[54] POLISHING APPARATUS

[75] Inventors: Seiji Katsuoka, Atsugi; Toyomi Nishi, Yokohama; Tetsuji Togawa, Chigasaki, all of Japan

[73] Assignee: Ebara Corporation, Tokyo, Japan

[21] Appl. No.: 08/864,905

[22] Filed: May 29, 1997

[30] Foreign Application Priority Data

May 29, 1996 [JP] Japan ..... 8-158962

[51] Int. Cl.[6] ..... B24B 1/00

[52] U.S. Cl. ..... 451/285; 451/286; 451/287; 451/288; 451/289; 454/187

[58] Field of Search ..... 451/41, 57, 285–289, 451/87, 88; 454/187

[56] References Cited

U.S. PATENT DOCUMENTS

| | | | |
|---|---|---|---|
| 2,935,820 | 5/1960 | Mead | 451/89 |
| 3,863,392 | 2/1975 | Haker | 451/89 |
| 4,838,150 | 6/1989 | Suzuki et al. . | |
| 5,138,807 | 8/1992 | Daw et al. | 454/187 |
| 5,144,781 | 9/1992 | Fitzner | 451/187 |
| 5,299,584 | 4/1994 | Miyazaki et al. | 134/56 |
| 5,522,767 | 6/1996 | Bertsche et al. | 454/187 |
| 5,679,059 | 10/1997 | Nishi et al. . | |

FOREIGN PATENT DOCUMENTS

| | | | |
|---|---|---|---|
| 406002904 | 1/1994 | Japan | 454/187 |
| 406221635 | 8/1994 | Japan | 454/187 |

*Primary Examiner*—Robert A. Rose
*Assistant Examiner*—George Nguyen
*Attorney, Agent, or Firm*—Wenderoth, Lind & Ponack, L.L.P.

[57] ABSTRACT

A polishing apparatus is used for polishing a workpiece such as a semiconductor wafer to a flat mirror finish. The polishing apparatus has an exhaust device for exhausting air in the polishing apparatus. The polishing apparatus includes a housing, a polishing section housed in the housing for polishing a workpiece, a cleaning section housed in the housing for cleaning the workpiece which has been polished, and a base comprising a plurality of structural members for supporting at least one device in at least one of the cleaning section and the polishing section. At least one of the structural members has a fluid passage therein and intake openings to serve as an exhaust duct. The polishing apparatus further comprises a main exhaust duct communicating with the exhaust duct and extending to an exterior of the housing for exhausting air introduced in the exhaust duct.

30 Claims, 6 Drawing Sheets

POLISHING APPARATUS

BACKGROUND OF THE INVENTION

1. Field of the Invention

The present invention relates to a polishing apparatus for polishing a workpiece such as a semiconductor wafer to a flat mirror finish, and more particularly to a polishing apparatus having an exhaust device for exhausting air in the polishing apparatus.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening thesurfaces of semiconductor wafers is to polish them with a polishing apparatus, and such a process is called Chemical Mechanical polishing.

Conventionally, a polishing apparatus has a polishing section comprising a turntable and a top ring which rotate at respective individual speeds. A polishing cloth is attached to the upper surface of the turntable. A semiconductor wafer to be polished is placed on the polishing cloth and clamped between the top ring and the turntable. An abrasive liquid containing abrasive grains is supplied onto the polishing cloth and retained on the polishing cloth.

During operation, the top ring exerts a certain pressure on the turntable, and the surface of the semiconductor wafer held against the polishing cloth is therefore polished to a flat mirror finish while the top ring and the turntable are rotated.

The polishing apparatus also has a cleaning section for conveying the semiconductor wafers and cleaning the semiconductor wafers. The cleaning section comprises a workpiece conveying robot for taking a semiconductor wafer out of a cassette and delivering the semiconductor wafer to the polishing section, a cleaning device for cleaning the semiconductor wafer which has been polished, a drying device for drying the semiconductor wafer which has been cleaned, and the like. The workpiece conveying robot, the cleaning device, the drying device and the like are housed in a single chamber.

FIG. 6 shows one conventional cleaning section of the polishing apparatus. As shown in FIG. 6, the cleaning section 150 comprises a base 151 comprising a plurality of structural members 157 such as H sections, a workpiece conveying robot 153 mounted on the central portion of the base 151, and a cleaning device 155 mounted on the base 151 and arranged on one side of the workpiece conveying robot 153. A drying device (not shown) is also mounted on the base 151. The structural members 157 are arranged not only at peripheral portions of the base 151 but also at the installation locations of various devices for supporting their weight.

An exhaust duct 159 is provided in the interior of the base 151. The exhaust duct 159 has a number of intake openings 161, and an upper end which is connected to a main exhaust duct 163 extending vertically through the base 151. The main exhaust duct 163 has an upper end which is connected to a filter unit 165. When a fan (not shown) provided in the filter unit 165 is driven, air in the cleaning section 150 moves downwardly, flows in the exhaust duct 159 through the intake openings 161, and then flows in the filter unit 165 through the exhaust duct 159 and the main exhaust duct 163. Dust or particles in the air are removed by the filter unit 165, and clean air is supplied into the interior of the cleaning section 150 from the filter unit 165. Thus, air in the cleaning section 150 is always kept clean.

However, in the conventional apparatus, since the exhaust duct 159 dedicated to exhaust of the cleaning section 150 is provided in the interior of the base 151, a large space for the exhaust duct 159 is required in the base 151. The base 151 bulky. Further, the base 151 and the exhaust duct 159 are required to be manufactured individually and to be assembled separately to thus increase their manufacturing and assembling costs.

SUMMARY OF THE INVENTION

It is therefore an object of the present invention to provide a polishing apparatus having an exhaust device which has a simple structure, allows a base for mounting various devices to be thin, and can reduce manufacturing and assembling costs thereof.

According to one aspect of the present invention, there is provided a polishing apparatus for polishing a surface of a workpiece comprising: a housing; a polishing section housed in the housing for polishing a surface of a workpiece; a cleaning section housed in the housing for cleaning the workpiece which has been polished; a base for supporting at least one device in at least one of the cleaning section and the polishing section, the base comprising a plurality of structural members, and at least one of the structural members having a fluid passage therein and intake openings to serve as an exhaust duct; and a main exhaust duct communicating with the exhaust duct and extending to an exterior of the housing for exhausting air introduced in the exhaust duct.

According to another aspect of the present invention, there is provided a cleaning apparatus for cleaning a workpiece comprising: a housing; at least one cleaning device housed in the housing; a base for supporting the cleaning device, the base comprising a plurality of structural members, and at least one of the structural members having a fluid passage therein and intake openings to serve as an exhaust duct; and a main exhaust duct communicating with the exhaust duct and extending to an exterior of the housing for exhausting air introduced in the exhaust duct.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

A polishing apparatus according to an embodiment of the present invention will be described below with reference to FIGS. 1 and 2.

Figure 1:
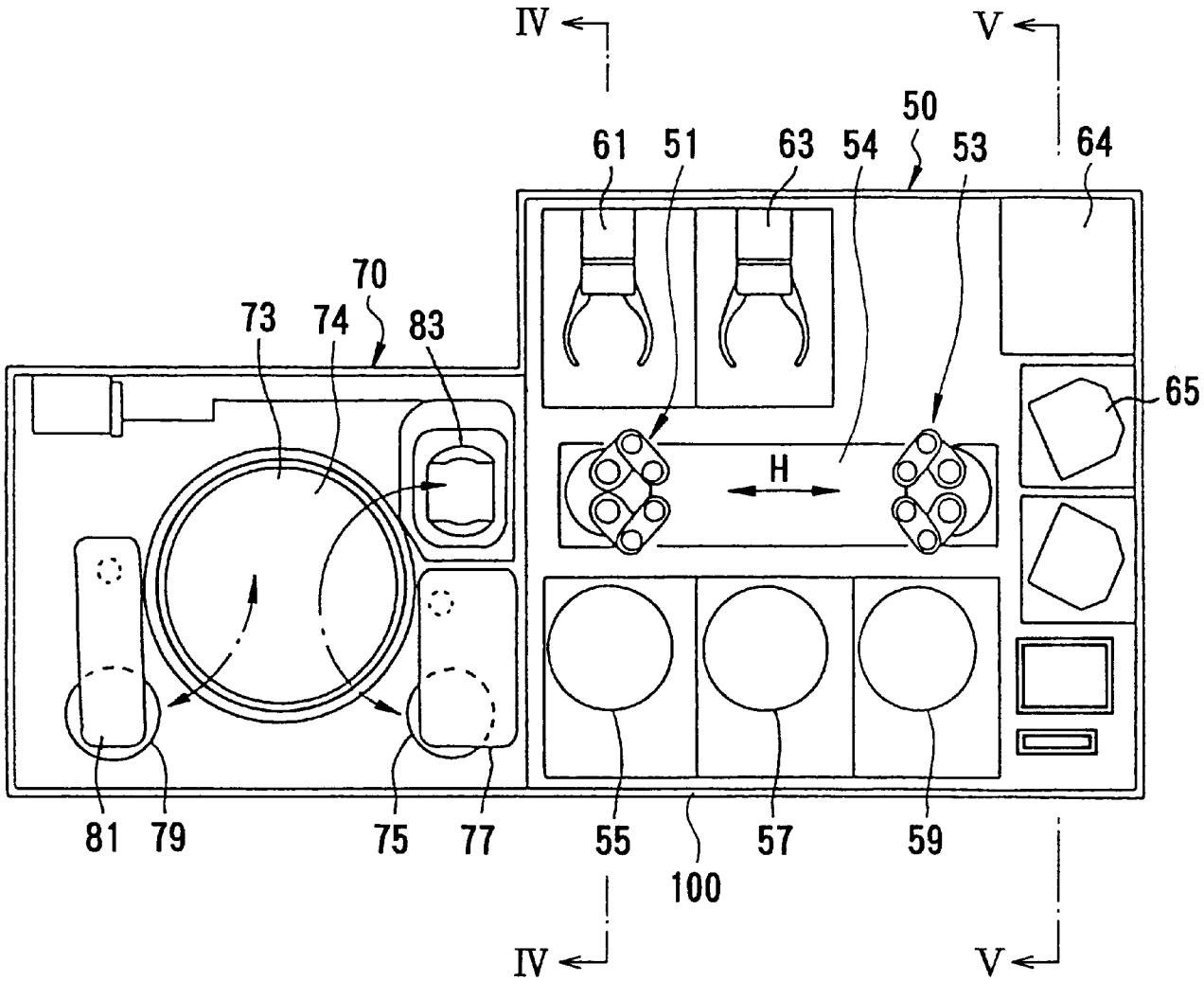
FIG. 1 is a schematic plan view of a polishing apparatus according to an embodiment of the present invention.

As shown in FIG. 1, a polishing apparatus comprises a polishing section 70 for polishing a workpiece such as a semiconductor wafer, and a cleaning section 50 for cleaning the workpiece which has been polished in the polishing section 70. The polishing section 70 comprises a central turntable 73, a polishing on top ring unit 77 disposed on one side of the turntable 73 and having a top ring 75, a dressing unit 81 disposed on the other side of the turntable 73 and having a dressing tool 79, and a workpiece transfer device 83 for transferring the workpiece between the top ring 75 and the workpiece transfer device 83. The turntable 73, the polishing unit 77, the dressing unit 81, and the workpiece transfer unit 83 are all housed in a housing 100 having walls.

The cleaning section 50 comprises a pair of central workpiece conveying robots 51, 53 movable in the directions indicated by the arrow H, primary and secondary cleaning devices 55, 57 and a spinning drier 59 which are arranged in an array on one side of the workpiece conveying robots 51, 53, and two workpiece reversing devices 61, 63 which are arranged in an array on the other side of the workpiece conveying robots 51, 53. The workpiece conveying robots 51, 53, the primary and secondary cleaning devices 55, 57 and the spinning drier 59, and the workpiece reversing devices 61, 63 are housed in the housing 100.

Figure 2:
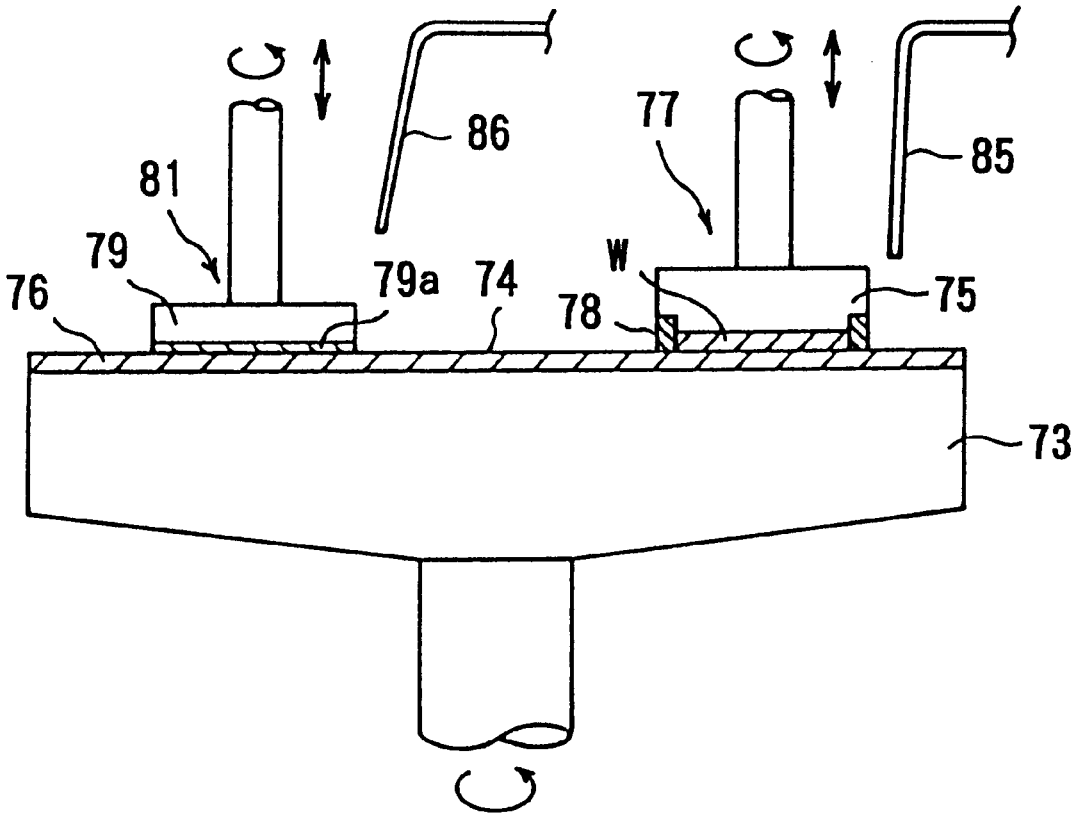
FIG. 2 is a cross-sectional view of a polishing section in the polishing apparatus.
Figure 3B:
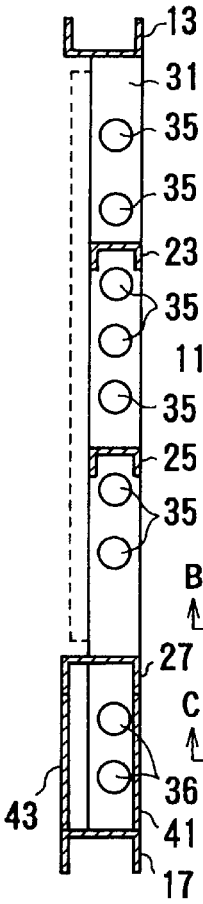
FIG. 3B is a cross-sectional view taken along line A—A of FIG. 3A.
Figure 3A:
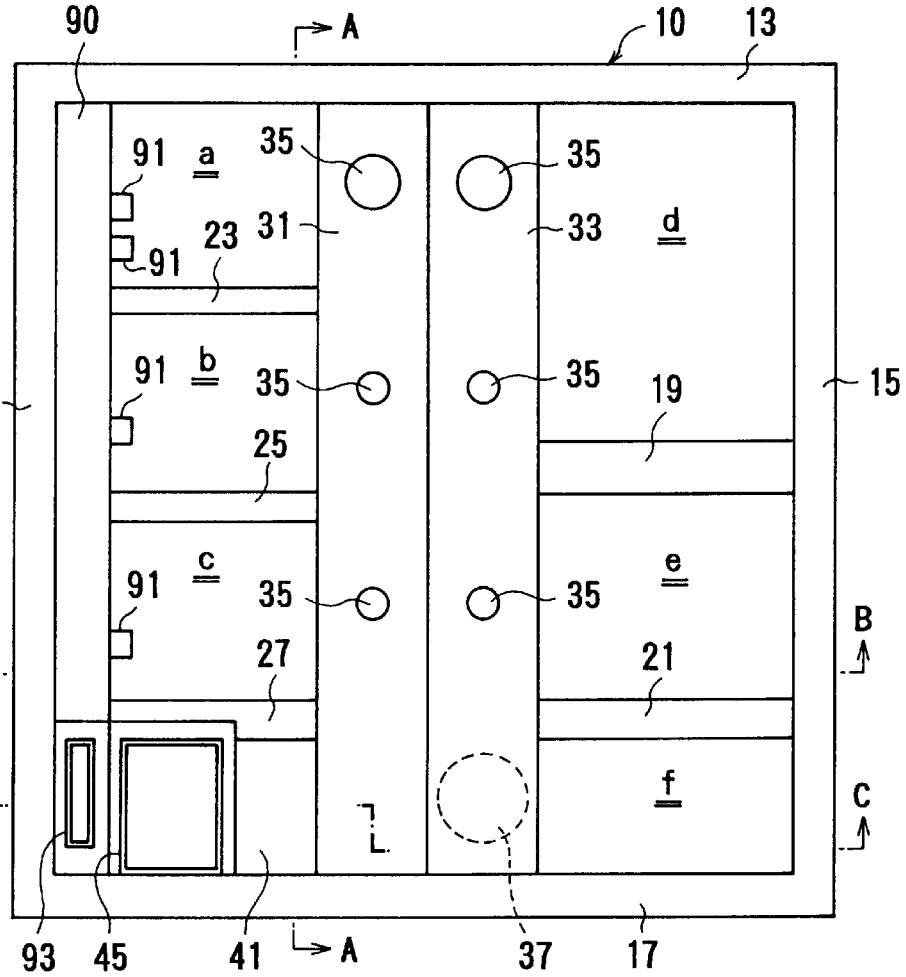
FIG. 3A is a plan view of a base of a cleaning section in the polishing apparatus.
Figure 3C:
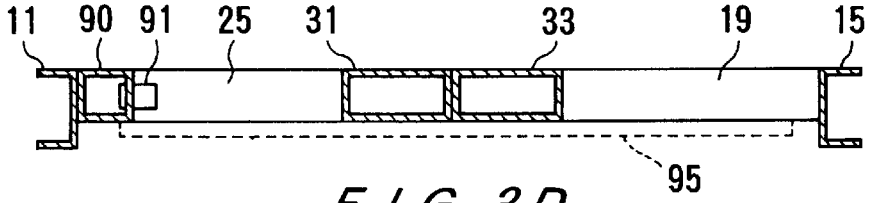
FIG. 3C is a cross-sectional view taken along line B—B of FIG. 3A.
Figure 3D:
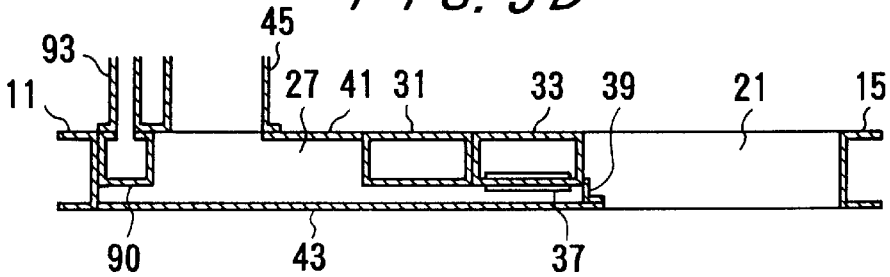
FIG. 3D is a cross-sectional view taken along line C—C of FIG. 3A.

FIG. 2 shows the polishing section 70 having the turntable 73, the top ring unit 77 and the dressing unit 81. The top ring unit 77 has the top ring 75 for supporting a semiconductor wafer W and pressing the semiconductor wafer W against the turntable 73. The turntable 73 is rotatable about its own axis as indicated by an arrow by a motor (not shown) which is coupled to the turntable 73. A polishing cloth 76 constituting a polishing surface 74 is attached to an upper surface of the turntable 73.

The top ring 75 is coupled to a motor (not shown) and also to a lifting/lowering cylinder (not shown). The top ring 75 is vertically movable and rotatable about its own axis as indicated by the arrows by the motor and the lifting/lowering cylinder. The top ring 75 can therefore press the semiconductor wafer W against the polishing cloth 76 under a desired pressure. The semiconductor wafer W is attached to a lower surface of the top ring 75 under a vacuum or the like. A guide ring 78 is mounted on the outer circumferential edge of the lower surface of the top ring 75 for preventing the semiconductor wafer W from being disengaged from the top ring 75. An abrasive liquid is supplied through a supply pipe 85 onto the polishing cloth 76.

The dressing unit 81 comprises the dressing tool 79 which is positioned above the turntable 73 in diametrically opposite relation to the top ring 75. A dressing liquid is supplied through a supply pipe 86 onto the polishing cloth 76. The dressing tool 79 is coupled to a motor (not shown) and also to a lifting/lowering cylinder (not shown). The dressing tool 79 is vertically movable and rotatable about its own axis as indicated by the arrows by the motor and the lifting/lowering cylinder. The dressing tool 79 has a dressing element 79*a* composed of, for example, nylon brush, or a diamond grain layer containing diamond grains on its lower surface.

Operation of the polishing apparatus comprising the polishing section 70 and the cleaning section 50 will be described below.

When a wafer cassette 65 which houses a plurality of semiconductor wafers to be polished is set in a position as shown in FIG. 1, the workpiece conveying robot 53 takes a semiconductor wafer out of the cassette 65, and transfers the semiconductor wafer to the workpiece reversing device 63. After the semiconductor wafer is reversed, i.e., turned upside down, by the workpiece reversing device 63, it is received by the workpiece conveying robot 51, and then placed onto the workpiece transfer device 83.

Thereafter, the top ring 75 of the polishing unit 77 is angularly displaced as indicated by the dot-and-dash line to a position directly above the workpiece transfer device 83. The semiconductor wafer on the workpiece transfer device 83 is lifted to a position near a lower surface of the top ring 75, and then attached to the top ring 75 under vacuum developed by a vacuum pump or the like (not shown).

Then, the top ring 75 is moved over the turntable 73, and presses the semiconductor wafer against the polishing surface 74 on the turntable 73. While the turntable 73 and the top ring 75 are rotated independently of each other, the lower surface of the semiconductor wafer is polished to a flat mirror finish. At this time, the abrasive liquid is supplied through the supply pipe 85 onto the polishing surface 74. After the semiconductor wafer is polished, the top ring 75 is moved back over the workpiece transfer device 83, and transfers the polished semiconductor wafer onto the workpiece transfer device 83.

The semiconductor wafer placed on the workpiece transfer device 83 is then held by the workpiece conveying robot 51, and transferred therefrom to the workpiece reversing device 61. The workpiece reversing device 61 reverses the semiconductor wafer. The reversed semiconductor wafer is transferred successively to the primary and secondary cleaning devices 55 and 57, and the spinning drier 59, whereby the semiconductor wafer is cleaned by cleaning liquid such as pure water and dried. The spinning drier 59 may have a function of cleaning and drying. The cleaned and dried semiconductor wafer is finally returned to the cassette 65 by the workpiece conveying robot 53.

After the semiconductor wafer is polished, the dressing tool 79 of the dressing unit 81 is angularly moved over the turntable 73 as indicated by the dot-and-dash-line arrow, and then presses the dressing tool 79 against the polishing surface 74 for thereby dressing the polishing surface 74. At this time, pure water is supplied as dressing liquid through the supply pipe 86 onto the polishing surface 74.

FIGS. 3A through 3D show a base 10 on which various devices are mounted in the cleaning section 50. As shown in FIGS. 3A through 3D, the base 10 comprises four structural members 11, 13, 15 and 17, made of structural steel and having substantially U-shaped cross-section, which are arranged at the periphery thereof, and two structural members 31 and 33, made of structural steel and having box-like cross-section, which connect the structural members 13 and 17. The base 10 further comprises two structural members 19 and 21, made of structural steel and having substantially U-shaped cross-section, which connect the structural members 33 and 15, and three structural members 23, 25 and 27, made of structural steel and having substantially U-shaped cross-section, which connect the structural members 31 and 11.

Figure 6:
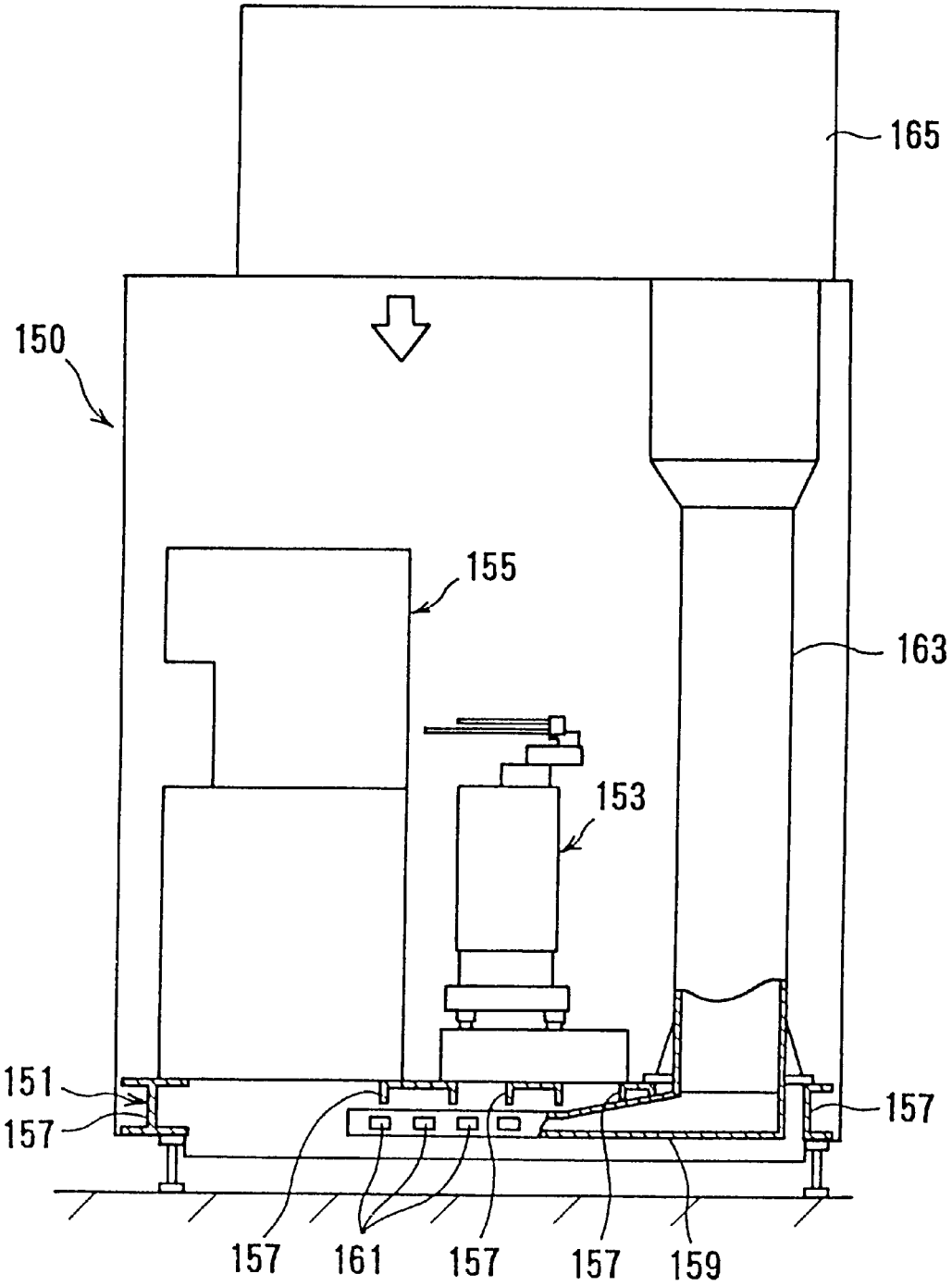
FIG. 6 PRIOR ART
FIG. 6 is a cross-sectional view of a cleaning section of a conventional polishing apparatus.

The structural members 11, 13, 15, 17, 19, 21, 23, 25, 27, 31 and 33 have respective upper surfaces which are aligned with or lie flush with one another. The structural members 31 and 33 constitute an exhaust duct, respectively because of their box-like cross-section. Circular intake openings 35 are formed in the structural members 31 and 33. That is, three intake openings 35 are formed at respective upper walls of the structural members 31 and 33, and seven intake openings 35 are formed at respective side walls of the structural members 31 and 33. Further, two circular outlet openings 36 are formed at an end portion of the side wall of the structural member 31. A circular outlet opening 37 is formed at an end portion of the bottom wall of the structural member 33. In FIGS. 3A through 3D, the intake openings 35 formed in the side walls of the structural member 33 are not shown, but are formed at the same locations as the structural member 31. Seven areas are defined by the structural members 11, 13, 15, 17, 19, 21, 23, 25, 27, 31 and 33, and among them, six areas a, b, c, d, e and f are open vertically. The remaining one area is closed by flat plates 41 and 43. A main exhaust duct 45 is connected to the upper flat plate 41 and extends upwardly from the upper surface of the base 10. The upper end of the main exhaust duct 45 is connected to the filter unit 165 (see FIG. 4) which is similar or identical to the filter unit 165 shown in FIG. 6. An angle member 39 is provided between the lower flat plate 43 and the structural member 33 to close the gap therebetween.

A local exhaust duct 90 made of structural steel and having a box-like cross-section is provided inside and along the structural member 11. This local exhaust duct 90 also serves as a structural member for reinforcing the base 10. The local exhaust duct 90 has a side wall having four intake openings 91, and an upper wall to which an exhaust pipe 93 is connected. The four intake openings 91 are connected to the primary and secondary cleaning devices 55 and 57, the spinning drier 59, and the workpiece reversing device 61, respectively by way of pipes (see FIG. 4). The exhaust pipe 93 extends to the exterior of the cleaning section 50. A container 95 for receiving leakage liquid may be accommodated in the base 10 as shown by dot lines.

The primary cleaning device 55 is located above the area a of the base 10 and is mounted on the structural members 11, 13 and 23. Similarly, the secondary cleaning device 57 is located above the area b of the base 10, the spinning drier 59 is located above the area c of the base 10, the workpiece reversing devices 61 and 63 are located above the area d of the base 10, and a control device 64 is located above the area f of the base 10. A support 54 (see FIG. 1) for supporting the workpiece conveying robots 51 and 53 is mounted on the structural members 31 and 33.

Figure 4:
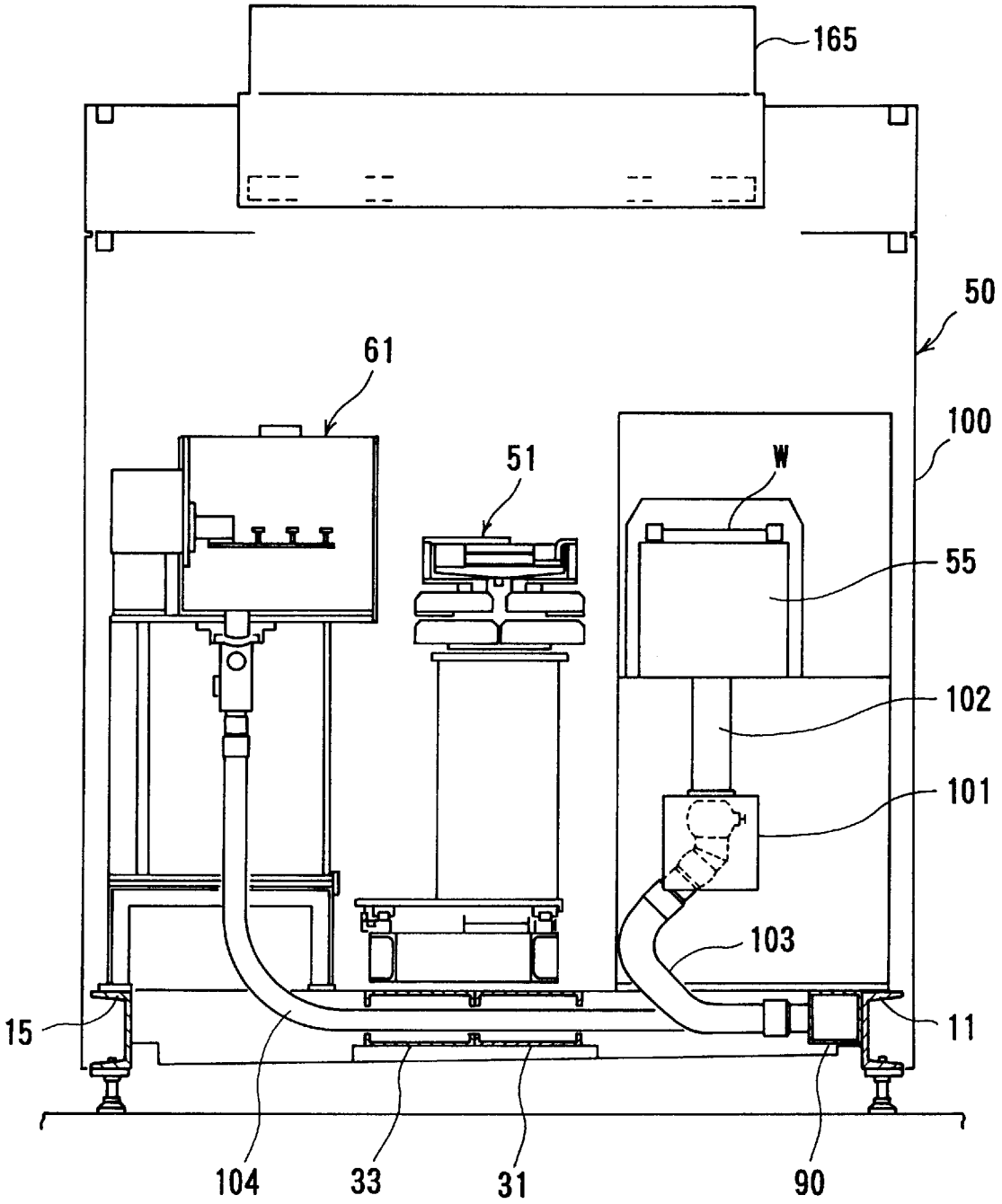
FIG. 4 is a cross-sectional view taken along line IV—IV of FIG. 1.
Figure 5:
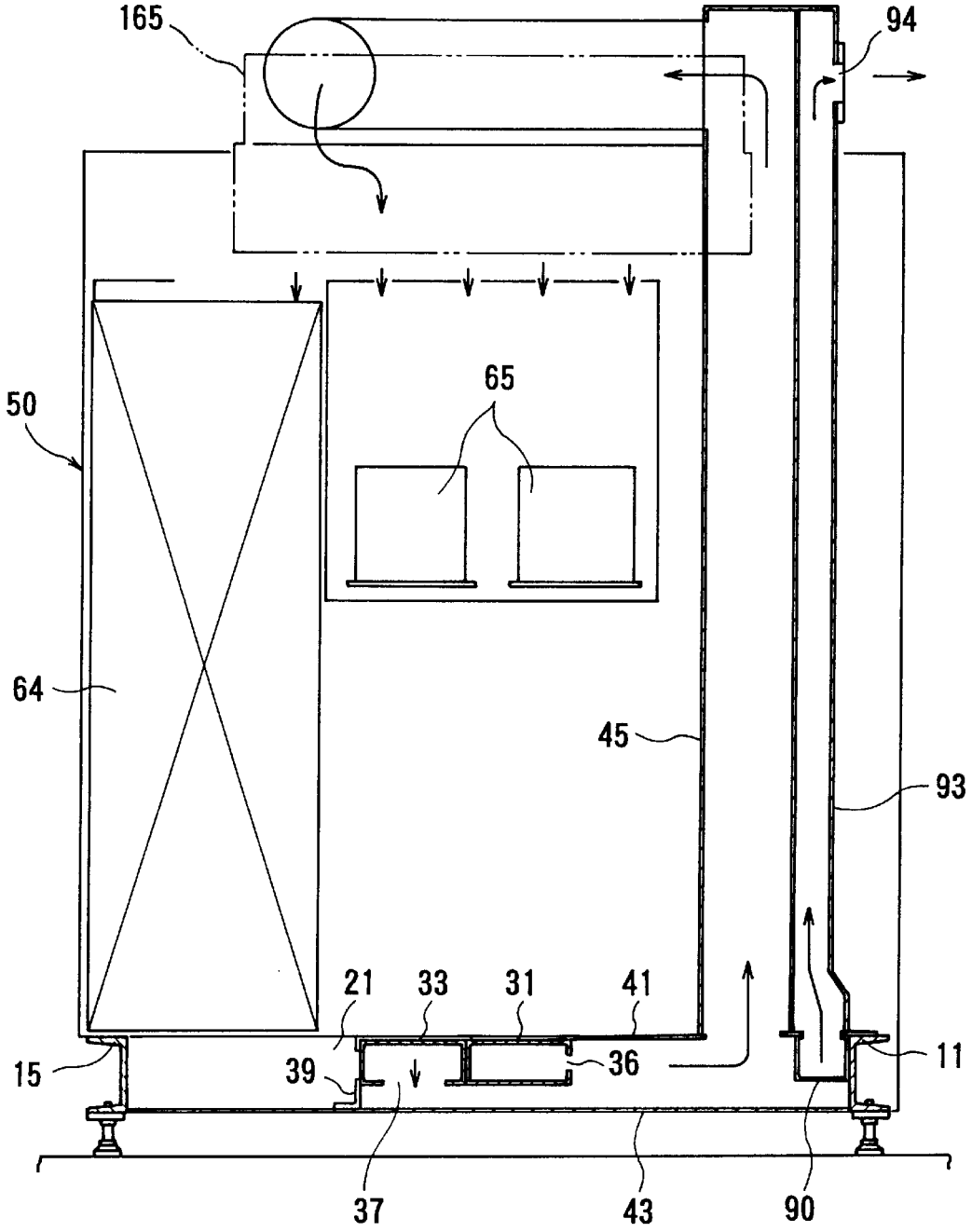
FIG. 5 is a cross-sectional view taken along line V—V of FIG. 1.

FIGS. 4 and 5 show the relationship between the base 10 and various devices, and FIG. 4 is a cross-sectional view taken along line IV—IV of FIG. 1 and FIG. 5 is a cross-sectional view taken along line V—V of FIG. 1. As shown in FIG. 4, the primary cleaning device 55 is connected to a separator 101 for separating air and liquid through a pipe 102. The separated air containing mist consisting of cleaning liquid is introduced into the local exhaust duct 90 through an exhaust pipe 103, and the separated liquid is introduced into a drain pipe (not shown) provided in the base 10 through a liquid pipe (not shown) connected to the separator 101. The workpiece reversing device 61 is connected to the local exhaust duct 90 through an exhaust pipe 104 which passes through the structural members 31 and 33. The exhaust pipes 103 and 104 are arranged such that they extend in the base 10 as much as possible to utilize the space in the base 10 effectively. The secondary cleaning device 57 and the spinning drier 59 are connected to the local exhaust duct 90, respectively in the same manner as the primary cleaning device 55. The workpiece reversing device 63 is connected to the local exhaust duct 90 in the same manner as the workpiece reversing device 61.

As shown in FIG. 5, the main exhaust duct 45 extends upwardly from the base 10, and is connected to the filter unit 165. The local exhaust duct 90 is connected to the exhaust pipe 93 which extends vertically and has an outlet opening 94 located at the exterior of the housing 100.

When the filter unit 165 is operated to develop negative pressure in the main exhaust duct 45, air which has flowed downwardly and passed through spaces between various devices flows in the exhaust ducts defined by the structural members 31 and 33 through the intake openings 35. Thereafter, air passes through the respective exhaust ducts defined by the structural members 31, 33, is discharged from the two outlet openings 36 formed in the side wall of the structural member 31 and the outlet opening 37 formed in the bottom wall of the structural member 33, and then flows in the space defined by the flat plates 41 and 43 and the structural members 11, 17 and 27. Further, air is introduced into the main exhaust duct 45 through the above space, passes through the main exhaust duct 45, and flows in the filter unit 165 in which dust or particles in the air are removed, and then clean air is supplied into the cleaning section 50 from the filter unit 165. Thus, air in the cleaning section 50 is always kept clean.

Air containing mist or the like discharged from the primary and secondary cleaning devices 55 and 57, the spinning drier 59 and the workpiece reversing devices 61 and 63 flows in the local exhaust duct 90 from the intake openings 91 through the respective exhaust pipes (see FIG. 4), passes through the exhaust duct 90 and the exhaust pipe 93, and is discharged from the outlet opening 94 to the exterior of the cleaning device 50.

As described above, in the illustrated embodiment, a relatively clean air in the housing 100 is introduced into the filter unit 165 through the exhaust duct comprising the structural members 31 and 33, and the main exhaust duct 45, and after removing particles in the air by the filter unit 165, clean air is supplied from the filter unit 165 into the housing 100, i.e., is circulated. On the other hand, a relatively dirty air containing mist or the like in the various devices 55, 57, 59 is discharged from the exhaust pipe 93 to the exterior of the cleaning section 50 through the local exhaust duct 90.

Although the exhaust device is described as being for use in a polishing apparatus, the exhaust device may be used in other semiconductor manufacturing apparatuses such as a resist processing apparatus or an etching processing apparatus. Further, the exhaust device may be used in various apparatuses other than such semiconductor manufacturing apparatuses.

Although the base 10 is incorporated in the cleaning section 50, it may be incorporated in the polishing section 70. Further, although the cleaning section 50 is incorporated in the polishing apparatus, it may be provided independently as a cleaning apparatus.

As is apparent from the above description, according to the present invention, since the exhaust ducts are composed of the structural members which constitute the base for mounting various devices, discrete and dedicated exhaust ducts are not required to be installed in the base. Therefore, the base can have a small height, and the exhaust ducts can be assembled simultaneously with assembling of the base, thus facilitating manufacturing and assembling of the exhaust ducts and reducing the costs of manufacturing and assembling of the exhaust ducts.

Although certain preferred embodiments of the present invention have been shown and described in detail, it should be understood that various changes and modifications may be made therein without departing from the scope of the appended claims.

What is claimed is:

1. A polishing apparatus for polishing a surface of a workpiece, said apparatus comprising:

a housing;

a polishing section housed in said housing for polishing a surface of a workpiece;

a cleaning section housed in said housing for cleaning the workpiece that has been polished;

a bas e supporting at least one device of at least one of said polishing section and said cleaning section, said base including a plurality of structural members;

at least one said structural member having a strength sufficient to serve as a structural support supporting the weight of said device, and said at least one structural member defining internally thereof an exhaust duct; and a main exhaust duct communicating with said exhaust duct for exhausting gas introduced into said exhaust duct.

2. An apparatus as claimed in claim 1, wherein said at least one structural member comprises a structural beam having a hollow interior defining said exhaust duct.

3. An apparatus as claimed in claim 2, wherein said structural beam has a hollow rectangular transverse cross-sectional configuration.

4. An apparatus as claimed in claim 1, further comprising a local exhaust duct incorporated in said base for exhausting gas from said device.

5. An apparatus as claimed in claim 4, wherein said local exhaust duct comprises another of said structural members.

6. An apparatus as claimed in claim 5, wherein said another structural member comprises a structural beam having a hollow interior defining said local exhaust duct.

7. An apparatus as claimed in claim 6, wherein said structural beam has a hollow rectangular transverse cross-sectional configuration.

8. An apparatus as claimed in claim 4, wherein said another structural member has therein intake openings connected by an exhaust pipe to said device.

9. An apparatus as claimed in claim 1, wherein said at least one structural member has therein intake openings communicating the interior of said housing with said exhaust duct.

10. An apparatus as claimed in claim 1, further comprising a filter unit connected to said main exhaust duct for removing particles contained in gas supplied from said main exhaust duct and for supplying clean gas into the interior of said housing.

11. A cleaning apparatus for cleaning a workpiece, said apparatus comprising:

a housing;

at least one cleaning device housed in said housing;

a base supporting said at least one cleaning device, said base including a plurality of structural members;

at least one said structural member having a strength sufficient to serve as a structural support supporting the weight of said cleaning device, and said at least one structural member defining internally thereof an exhaust duct; and a main exhaust duct communicating with said exhaust duct for exhausting gas introduced into said exhaust duct.

12. An apparatus as claimed in claim 11, wherein said at least one structural member comprises a structural beam having a hollow interior defining said exhaust duct.

13. An apparatus as claimed in claim 12, wherein said structural beam has a hollow rectangular transverse cross-sectional configuration.

14. An apparatus as claimed in claim 11, further comprising a local exhaust duct incorporated in said base for exhausting gas from said cleaning device.

15. An apparatus as claimed in claim 14, wherein said local exhaust duct comprises another of said structural members.

16. An apparatus as claimed in claim 15, wherein said another structural member comprises a structural beam having a hollow interior defining said local exhaust duct.

17. An apparatus as claimed in claim 16, wherein said structural beam has a hollow rectangular transverse cross-sectional configuration.

18. An apparatus as claimed in claim 14, wherein said another structural member has therein intake openings connected by an exhaust pipe to said cleaning device.

19. An apparatus as claimed in claim 11, wherein said at least one structural member has therein intake openings communicating the interior of said housing with said exhaust duct.

20. An apparatus as claimed in claim 11, further comprising a filter unit connected to said main exhaust duct for removing particles contained in gas supplied from said main exhaust duct and for supplying clean gas into the interior of said housing.

21. An exhaust device for use in a semiconductor manufacturing apparatus that includes a housing, at least one processing device housed in the housing, and a base for supporting the processing device, said exhaust device comprising:

a structural member forming part of the base and having a strength sufficient to serve as a structural support to support the weight of the processing device;

said structural member defining internally thereof an exhaust duct; and a main exhaust duct communicating with said exhaust duct for exhausting gas introduced into said exhaust duct.

22. An exhaust device as claimed in claim 21, wherein said structural member comprises a structural beam having a hollow interior defining said exhaust duct.

23. An exhaust device as claimed in claim 22, wherein said structural beam has a hollow rectangular transverse cross-sectional configuration.

24. An apparatus as claimed in claim 21, further comprising a local exhaust duct to be incorporated into the base for exhausting gas from the processing device.

25. An exhaust device as claimed in claim 24, wherein said local exhaust duct comprises another structural member of the base.

26. An exhaust device as claimed in claim 25, wherein said another structural member comprises a structural beam having a hollow interior defining said local exhaust duct.

27. An exhaust device as claimed in claim 26, wherein said structural beam has a hollow rectangular transverse cross-sectional configuration.

28. An exhaust device as claimed in claim 24, wherein said another structural member has therein intake openings connected to an exhaust pipe to be connected to the processing device.

29. An exhaust device as claimed in claim 21, wherein said structural member has therein intake openings to communicate the interior of the housing with said exhaust duct.

30. An exhaust device as claimed in claim 21, further comprising a filter unit connected to said main exhaust duct for removing particles contained in gas supplied from said main exhaust duct and for supplying clean gas into the interior of the housing.

* * * * *